US007980178B1

(12) United States Patent
Yalamanchili et al.

(10) Patent No.: US 7,980,178 B1
(45) Date of Patent: Jul. 19, 2011

(54) ENVIRONMENTALLY FRIENDLY PERCUSSION PRIMER

(75) Inventors: Rao Yalamanchili, Flanders, NJ (US); Michael E. Ellis, Lake Hopatcong, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 12/704,707

(22) Filed: Feb. 12, 2010

(51) Int. Cl.
*F42C 19/10* (2006.01)
*C06C 7/00* (2006.01)

(52) U.S. Cl. ..... 102/204

(58) Field of Classification Search ..... 102/204
See application file for complete search history.

(56) References Cited

U.S. PATENT DOCUMENTS

| | | | | |
|---|---|---|---|---|
| 2,423,837 | A * | 7/1947 | Martin | 102/204 |
| 3,688,702 | A * | 9/1972 | Prior et al. | 102/204 |
| 4,464,990 | A * | 8/1984 | Bendler et al. | 102/204 |
| 5,187,319 | A * | 2/1993 | Nouguez et al. | 102/202.1 |
| 5,717,159 | A * | 2/1998 | Dixon et al. | 149/40 |
| 2008/0245252 | A1 * | 10/2008 | Erickson et al. | 102/204 |

* cited by examiner

*Primary Examiner* — James S Bergin
(74) *Attorney, Agent, or Firm* — Henry S. Goldfine

(57) ABSTRACT

A cartridge containing an environmentally friendly percussion primer employing a primer explosive mixture, packed under the paper disc and anvil; the mixture being a metastable interstitial composite (MIC) and a high explosive; and a second mass of high explosive, packed within the primer cup above the anvil—which mass of high explosive is ignited by the detonation of the MIC and high explosive mixture—thereby adding to the detonation to create a combined, enhanced pressure and temperature wave to more quickly initiate the booster pellet and propellant, to fire the bullet within the subject action time limit—even under extreme cold ambient conditions.

3 Claims, 2 Drawing Sheets

ENVIRONMENTALLY FRIENDLY PERCUSSION PRIMER

FEDERAL INTEREST STATEMENT

The inventions described herein may be manufactured, used and licensed by the United States Government for United States Government purposes without payment of any royalties thereon or therefore.

CROSS REFERENCE TO RELATED APPLICATION

This application claims the benefit of U.S. patent application Ser. No. 12/119,021, which claimed priority from Provisional Application 60/917,412 filed May 11, 2007 the entire file wrapper contents of which applications are incorporated herein, as if set forth in their complete length.

FIELD OF THE INVENTION

This invention relates generally to the field of cartridge primers and more particularly to a medium caliber cartridge percussion primer which exhibits improved ignition train performance while producing a lesser environmental impact.

BACKGROUND OF THE INVENTION

A cartridge packages a bullet, propellant, and a primer into a single metallic case which is dimensioned precisely to be fired from a given caliber weapon. The cartridge primer is usually in the form of a small metallic cup, about 4 to 6 mm in diameter, which cup is friction fit within a rearwardly open metal bore formed in the base of the cartridge case. Typically, the cartridge primer contains a precise quantity of impact or pressure sensitive explosive material which is packed in place and covered by a thin paper disc, over which is fitted a single or grouping of metallic sections which function as an anvil—such that when the pressure sensitive explosive material is subjected to a physical force, such as that created between a firing pin and the anvil, the shock detonates the sandwiched explosive material which—in turn—expels hot gases up a channel within the base of the cartridge, igniting a booster capsule or pellet within that channel. The combined explosive effect of the primer and the booster pellet ignites the propellant contained in the body of the cartridge, which generates significant hot, rapidly expanding gases, thereby propelling the bullet from the cartridge and from the weapon.

Unfortunately, the pressure sensitive explosive materials use in primers, are hazardous or otherwise environmentally "unfriendly," such as lead styphnate, lead azide, mercury (II) fulminate, potassium perchlorate, or diazodinitrophenol (DDNP). Prior attempts to reduce or substitute less hazardous or more environmentally friendly material have met with limited success, due—in part—to the fact that proposed substitute pressure sensitive materials, such as metastable interstitial composite (MIC) disclosed in U.S. Pat. No. 5,717,159 (comprising an oxidizer, such as molybdenum trioxide, and a fuel, such as nano-sized aluminum powder), does not produce sufficient gas upon combustion to perform effectively in existing medium caliber cartridges under cold conditions. Specifically, it has been found in the case of medium caliber, e.g. 25 mm cartridges, under cold conditions, the MIC of U.S. Pat. No. 5,717,159 fails to generate sufficient gas upon combustion to achieve an acceptable firing action time, i.e. a cycle time of less than the 6 milliseconds, the standard set by the U.S. Army. In fact, the U.S. Army standard requires this less than 6 millisecond action time at temperatures as low as −65 degrees Fahrenheit—a temperature at which such MIC primer materials uniformly fail to achieve the required action standard. Failure to achieve such an action time can potentially cause severe accidents, due to the internal ballistics within the barrel, when a subsequent bullet is fired too soon after a delayed prior bullet.

It is important to note that the less than 6 millisecond action time discussed above is a limitation required of 100% of the fielded cartridges. This means that any manufacturer of such bullets must utilize a primer for their cartridges that will meet this requirement, at all temperature ranges, repeatable. The particular primer disclosed and claimed herein, does meet the subject action standard criteria, repeatable, 100% of the time, even at very low temperatures.

Therefore there is a need in the art for an environmentally friendly, MIC based primer for medium caliber cartridges that will meet the action standard time repeatedly, especially under extremely cold conditions.

SUMMARY OF THE INVENTION

To fulfill the above detailed needs, there has been an advance in the art according to the principles of the present invention directed to a medium caliber cartridge primer which (1) does not contain any lead or otherwise environmentally hazardous compound; which (2) physically fits within the constraints of existing primer cups; and which (3) when subjected to a percussion will provide sufficient detonation effect, i.e. high gas pressure and temperature detonation wave traveling at supersonic velocities, to ignite booster pellet and subsequently the mass of propellant (i.e. about 100 gm in a typical 25 mm cartridge), to fire the bullet within the required action time, even under extremely cold conditions. The primer of the present invention is composed of an environmentally friendly primer explosive of a mixture of an MIC and a high explosive, such as PETN, that is initially detonated by the shock/percussion of the firing pin, and a second mass of high explosive, packed within the primer cup so as to fill any space between the anvil and the top of the primer cup—which mass of high explosive is ignited by the detonation of the first MIC and high explosive mixture, and thereby adds to that detonation so as to create a combined pressure and temperature wave to, as stated, initiate the booster pellet and subsequently the propellant mass, and to fire the bullet within the action time limit, even under extremely cold conditions.

Surprisingly, the shock wave created by the present invention provides a significantly faster pressure increase than occurred in the prior art—as, apparently, a significant portion of the prior art primer detonation energy was dissipated in the void over the anvil in the primer cup. By eliminating this void, by filling the portion of the primer cup over the anvil with an explosive composition—energy is not dissipated and filling the space with a high explosive adds extra-energy. Thus, this elimination of the void over the anvil and the addition of explosive over the anvil have in combination led to a faster generated and significantly stronger primer pressure wave, which translates into a shorter and more reliable cycle time, regarding the firing of each cartridge.

A particular exemplary embodiment of the primer of the present invention for a 25 mm medium caliber cartridge is constructed by (1) sandwiching under the paper disc and anvil of a standard medium caliber primer cup, about 200 mg of a sensitive detonation composition, the primer explosive, which is composed of an environmentally friendly metastable interstitial composite (MIC) of about 39.9-41.2 weight percent nano-aluminum fuel and about 49.6 to 51.3 weight percent molybdenum trioxide oxidizer; plus about 5 to 8 weight percent pentaerythritol tetranitrate (PETN) high explosive, and about 2 weight percent of a binder, such as gum Arabic, and an anti-oxidant coating for the aluminum of about 0.5 weight percent ammonium di-phosphate; and (2) packing any available space between the top of the anvil to the top of the primer cup with about 100 mg of a high explosive, which can be any commercially available high explosive, such as RDX, HMX, CL-20, PBXN-5, boron potassium nitrate, or the like, or a mixture thereof. A primer cup of the present invention for a small caliber cartridge, such as a 5.56 mm cartridge would be of the same configuration and constituent ingredients, simply proportioned down to the fit within the smaller volume of the small caliber cartridge primer cup.

In sharp contrast to the prior art—primers constructed according to the present invention do not contain any explosive lead compounds and the ammunition cartridges or shells constructed according to the present invention do not require modifications to existing primer or cartridge hardware or additional flash tubes or ignition tubes.

BRIEF DESCRIPTION OF THE DRAWINGS

Further features and advantages of the present invention may be understood from the drawings in which.

DETAILED DESCRIPTION

Figure 1:
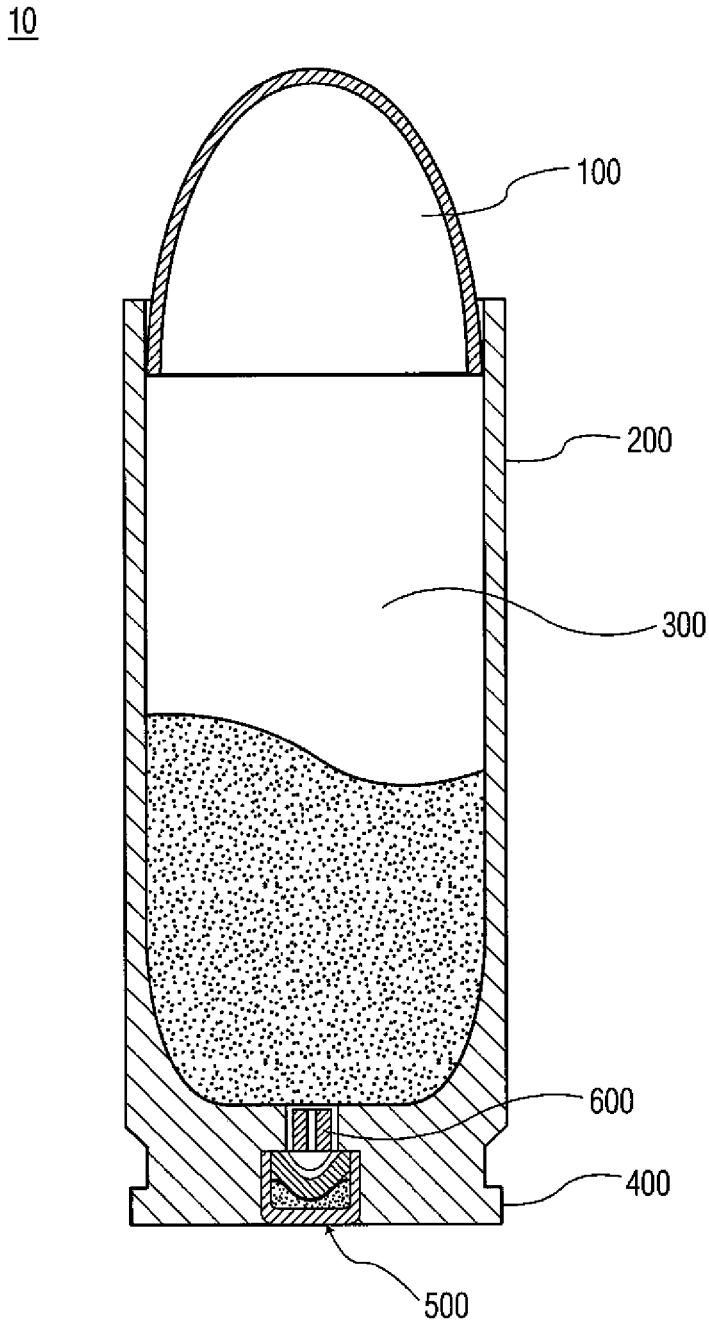
FIG. 1 PRIOR ART
FIG. 1 is a cut away view of a typical small or medium caliber cartridge of the prior art.

By way of some additional background and to introduce any nomenclature for the complete understanding of the present invention, reference is made to FIG. 1, which shows cut away view of a typical small or medium caliber cartridge 10 or round of the prior art. Regardless of caliber, such rounds typically include a case or casing 200, a projectile or bullet 100 (only the upper portion of which is shown), a quantity of propellant or powder 300 (only a representative quantity of which is shown), a booster pellet 600, and a cartridge primer 500. The cartridge 10 is a stand-alone module having mechanical integrity, so as to seal therein sensitive chemical compounds from the external environment, while keeping together all the components necessary for firing the round.

With respect to the known components of a typical cartridge of the prior art as shown in FIG. 1:

The bullet 100 or projectile is what is driven down a firearm barrel by the pressure of hot gases generated by the burning propellant 300. As those skilled in the art will readily appreciate, projectiles are made in a variety of shapes/sizes/functions for various applications and their discussion is not required for further understanding of the instant invention. Suffice to say, projectile design is a specialized sub-field of firearm/artillery design and involves much design and experimentation. Advantageously, the present invention is insensitive to specific projectiles and works with all.

The case or casing 200 is a carrier that holds the propellant 300, primer 500, and projectile 100 securely. Accordingly, this is what makes the transportation and deployment of the components as a single module or cartridge 10. Casings are typically made from brass or steel.

The primer 500 is typically cup-shaped and contains percussion sensitive explosive compounds containing lead styphnate. Other such typical, prior art primer compounds comprise barium nitrate, antimony sulfide, atomized aluminum, PETN, tetracene and gum Arabic as a binder. When struck, the primer compounds detonate and the primer expels hot gases and burning particles into the propellant 300.

Figure 2:
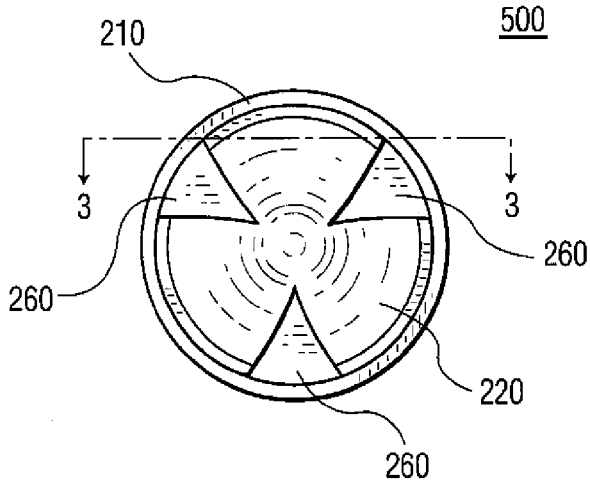
FIG. 2 PRIOR ART
FIG. 2 is a top down view of a cartridge primer, clearly showing an anvil according to the prior art.

Turning now to FIG. 2, there is shown a top looking down view of a primer 500 of the prior art. The cartridge primer 500 comprises an external primer cup 210 having a paper disc 260 disposed therein, and an anvil 220 disposed over the paper disc. In an area beneath the paper disc 260 is disposed primer explosive (shown in FIG. 3 as element 230). With this configuration, when the bottom portion of the primer cup 210 is struck (as by a firing pin, not shown), the cup 210 deforms, "pinching' the primer explosive between the primer cup and the anvil 220. The force imparted by this "pinching" causes the primer explosive to detonate and expel hot gases and particles through the open segments between the areas covered by the anvil 220. These hot gases and particles, from this initial detonation, ignite the explosive material in the booster pellet 600, which as shown in FIG. 1, is located immediately above the primer 500.

Figure 3:
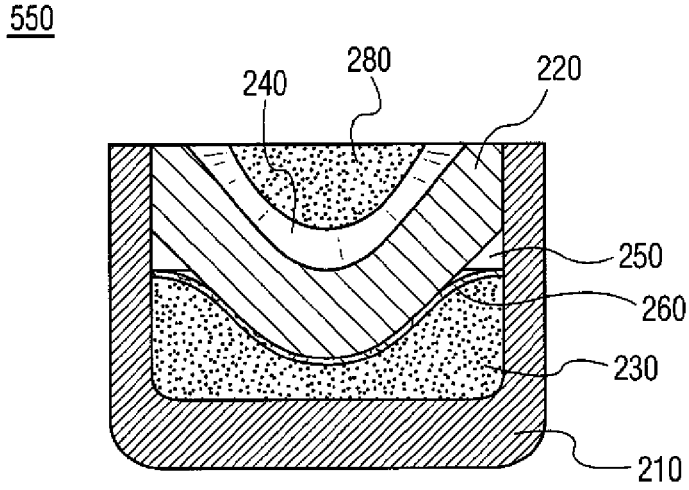
FIG. 3 is a cut away view of a primer according to the present invention, as seen along section 3-3 of FIG. 2.

In contrast to the above, in the present invention as shown in FIG. 3, a quantity of high explosive material 280 is packed into the top of the primer 500, above the curved upper surface 240 of the anvil 220. Such that, when the primer explosive 230 is detonated the resulting hot gasses and particles detonate the mass of high explosive 280 packed into the area on top of the anvil 240 and the booster pellet 600, an enhanced energy wave will be created that causes the propellant 300 to rapidly ignite, surprisingly, such that even in extremely cold temperatures, such as −65 degrees Fahrenheit, the bullet will be fired within the desired overall action time.

As stated above, the primer explosive 230 is a mixture of an environmentally friendly metastable interstitial composite of about 39.9-41.2 weight percent nano-aluminum fuel, preferably about 41 weight percent; and about 49.6 to 51.3 weight percent molybdenum trioxide oxidizer, preferably about 51 weight percent; plus about 5 to 8 weight percent pentaerythritol tetranitrate (PETN) high explosive, preferably about 5.5 weight percent, and about 2 weight percent of a binder, such as gum Arabic, and an anti-oxidant coating for the aluminum of about 0.5 weight percent ammonium di-phosphate. The overall quantity of the primer explosive, in a 25 mm cartridge primer would be about 200 mg. The nano-aluminum fuel is preferably composed of particles which on average are 80 nanometers in diameter. The oxidizer is about 300 nanometers in diameter. However, smaller particles for both fuel and oxidizer can be used. As a matter of fact, smaller the better because of possible intimate contact between fuel and oxidizer causes more rapid combustion thereafter.

As stated above, the mass of high explosive packed into the area on top of the anvil 240, would be for a 25 mm cartridge about 100 mg. Also, as stated, any commercially available high explosive is usable in the subject invention, including RDX, HMX, CL-20, PBXN-5, boron potassium nitrate, or the like, or any combination thereof. The mass of high explosive would be packed so as to be relatively flush with the top edge of the primer cup.

An alternative embodiment of the present invention useful as a primer for a small caliber cartridge, such as a 5.56 mm cartridge would be of the same configuration and ingredients as detailed above. However, while the proportions would remain the same the quantities would have to be proportioned down to the fit within the smaller volume of the small caliber cartridge primer cup.

At this point, while we have discussed and described the invention using some specific examples, those skilled in the art will recognize that our teachings are not so limited. For example, the preferred embodiments of the invention have been provided for the purpose of explaining the principles of the invention and its practical application, thereby enabling others skilled in the art to understand the invention. Various embodiments and various modifications are contemplated. Accordingly, the invention should be only limited by the scope of the claims attached hereto. The above merely illustrates the principles of the invention. It will thus be appreciated that those skilled in the art will be able to devise various arrangements which, although not explicitly described or shown herein, embody the principles of the invention and are included within its spirit and scope.

The invention claimed is:

1. An environmentally friendly percussion primer which provides a fast action time when utilized with existing medium caliber cartridges, comprising:

a primer cup;

a primer anvil disposed within the primer cup over a thin paper disc;

a quantity of primer explosive comprised of a mixture of an environmentally friendly metastable interstitial composite and a high explosive, which quantity of primer explosive is located between the bottom of the primer cup and the thin paper disc; and a second mass of high explosive, which mass is packed within the primer cup above the anvil;

wherein, the quantity of primer explosive to high explosive is about 2:1, whereby when the combination of the primer explosive and second mass of high explosive is detonated under extremely cold conditions the action time of the cartridge will be less than 6 milliseconds.

2. The environmentally friendly percussion primer of claim 1 wherein, the medium caliber cartridge is a 25 mm cartridge and the quantity of primer explosive is 200 mg of a sensitive detonation composition of about 39.9-41.2 weight percent nano-aluminum fuel and about 49.6 to 51.3 weight percent molybdenum trioxide oxidizer; plus about 5 to 8 weight percent pentaerythritol tetranitrate (PETN) high explosive, and about 2 weight percent of a binder, such as gum Arabic, and an anti-oxidant coating for the aluminum of about 0.5 weight percent ammonium di-phosphate; and the mass of high explosive packing is about 100 mg of a high explosive.

3. The environmentally friendly percussion primer of claim 1 wherein, the mass of high explosive is composed of a quantity of about 100 mg of high explosive, selected from the group consisting of RDX, HMX, CL-20, PBXN-5, boron potassium nitrate or a combination thereof.

* * * * *